US009086072B1

(12) United States Patent
Davis

(10) Patent No.: US 9,086,072 B1
(45) Date of Patent: Jul. 21, 2015

(54) TABLETOP AIR COOLER

(71) Applicant: Marvin Robert Davis, Capitola, CA (US)

(72) Inventor: Marvin Robert Davis, Capitola, CA (US)

( * ) Notice: Subject to any disclaimer, the term of this patent is extended or adjusted under 35 U.S.C. 154(b) by 18 days.

(21) Appl. No.: 14/288,038

(22) Filed: May 27, 2014

(51) Int. Cl.

| | |
|---|---|
| ***F04D 25/06*** | (2006.01) |
| ***F04D 29/62*** | (2006.01) |
| ***F04D 29/70*** | (2006.01) |
| *F04D 19/00* | (2006.01) |
| *F04D 25/16* | (2006.01) |

(52) U.S. Cl.
CPC ..... *F04D 25/0673* (2013.01); *F04D 29/624* (2013.01); *F04D 29/703* (2013.01); *F04D 19/002* (2013.01); *F04D 25/166* (2013.01)

(58) Field of Classification Search
CPC ..... F04D 25/08; F04D 17/08; F04D 25/0673; F04D 25/0693; F04D 25/166; F04D 29/601; F04D 29/624; F04D 29/703; A47B 11/00; A47G 23/08
USPC ..... 417/423.1, 423.5, 423.15, 423.14, 572, 417/411; 318/139
See application file for complete search history.

(56) References Cited

U.S. PATENT DOCUMENTS

| | | | | | |
|---|---|---|---|---|---|
| 1,214,676 | A * | 2/1917 | Herzog | 312/305 |
| 2,459,017 | A * | 1/1949 | Crew | 108/139 |
| 2,905,377 | A * | 9/1959 | Gow | 415/143 |
| 3,920,295 | A * | 11/1975 | Speckin | 312/108 |
| 5,193,984 | A * | 3/1993 | Lin | 416/247 R |
| 5,348,563 | A * | 9/1994 | Davis | 55/385.2 |
| 6,050,551 | A * | 4/2000 | Anderson | 261/30 |
| 6,098,175 | A * | 8/2000 | Lee | 713/320 |
| 6,796,318 | B2 * | 9/2004 | Cohen et al. | 135/16 |
| 7,025,798 | B2 * | 4/2006 | Endo | 55/385.1 |
| 7,112,232 | B2 * | 9/2006 | Chang et al. | 55/481 |
| 7,173,353 | B2 * | 2/2007 | Lopatinsky et al. | 310/58 |
| 7,222,634 | B2 * | 5/2007 | Hess et al. | 135/93 |
| 2013/0216213 | A1 * | 8/2013 | Thomas | 392/465 |

* cited by examiner

*Primary Examiner* — Devon Kramer
*Assistant Examiner* — Joseph Herrmann
(74) *Attorney, Agent, or Firm* — Donald R. Boys; Central Coast Patent Agency, Inc.

(57) ABSTRACT

An apparatus has a housing having a top and bottom and a sidewall, with one or more horizontally-directed outlet openings through the sidewall and one or more inlet openings through the top, bottom or sidewall, one or more fans positioned to draw air through the one or more inlet openings, and to the air outward through the one or more horizontally-directed outlet openings, and a power source for the one or more fans, suitably connected through an on-off switch to turn the one or more fans on and off.

8 Claims, 5 Drawing Sheets

TABLETOP AIR COOLER

BACKGROUND OF THE INVENTION

1. Field of the Invention

The present invention is in the technical area of air circulation apparatus, and pertains more particularly to an apparatus for use with tables.

2. Description of Related Art

Outdoor patio dining and living has become very popular. People like to have furniture made specifically for such use. It is common to have a patio table with an umbrella and a set of chairs for such purpose. To combat the hot tropical outdoor effects, electric fans are placed near the patio furniture for air circulation to make the outdoor patio experience more enjoyable. However even with the ability to undergo vertical and horizontal rotations, existing electric fans are driven by an inner motor to blow air in a unidirectional manner. The conventional electric fan only generates one flow of air, providing relief only in a single direction at a time. An electric fan also needs to be connected to an electrical outlet for power with an electric cord. The electric cord may become tangled and become a tripping hazard. Noise generated by electric fans from the motor and rapid flow of air around blades tends to impact the relaxing outdoor experience. With their motor, blades, and structural support, the electric fans are bulky, occupy valuable patio space, prone to topple, and do not blend well with the overall aesthetics of the patio environment.

Hence, there is a need for a compact, low-noise, and hazard-free apparatus capable of generating streams of air flow in a directed manner for use in the outdoor patio setting, and indoors as well. Such an apparatus would be useful especially in the restaurant business.

BRIEF SUMMARY OF THE INVENTION

In one embodiment of the invention an apparatus is provided comprising a housing having a top, a bottom and a sidewall, the bottom adapted to support the housing on a tabletop, one or more horizontally-directed outlet openings through the sidewall and one or more inlet openings through the top or bottom of the housing, one or more fans mounted within the housing, positioned to draw air through the one or more inlet openings, and to urge the air horizontally outward through the one or more horizontally-directed outlet openings, and a power source coupled to the one or more fans, connected through an on-off switch to turn the one or more fans on and off.

In one embodiment the housing is circular in aspect, and the horizontally-directed outlet openings are positioned around the sidewall. Also in one embodiment the outlet openings are evenly spaced around the periphery of the sidewall. Also in one embodiment the apparatus further comprises moveable directional vanes implemented at individual ones of the horizontally-directed outlets, providing for controlling direction of air from the outlets.

In one embodiment the power source is a battery pack implemented in the housing. Also in one embodiment the batteries are rechargeable, and the apparatus includes a port for connecting to a power supply for recharging the batteries. Also in one embodiment the housing is a first housing enclosing the fans but not the battery pack, wherein the battery pack is implemented in a separate second housing spaced apart above or below the first housing by a plurality of spacers. Still in one embodiment the first housing is spaced apart above the second housing enclosing the battery pack, and the inlet openings are through the bottom of the first housing into space between the first and second housing, such that air is drawn into the space between the first and second housings.

In one embodiment the apparatus further comprises a vertically-oriented central opening in the housing through which a post for an umbrella may pass. Also in one embodiment a filter material is provided around the periphery of the space between the first and the second housing to filter air drawn into the apparatus. Also in one embodiment there is a vertically-oriented central opening through both the first and the second housing, through which a post for an umbrella may pass, and the periphery of the space between the first and the second housings is blocked, such that air must be drawn from the vicinity of the central hole.

In one embodiment there is a vertically-oriented central opening through both the first and the second housing, through which a post for an umbrella may pass, wherein the housing are split through the center into minor-image units, such that the minor image units may be joined around an umbrella post, or may be separated and removed. Also in one embodiment the mirror image assemblies are hinged on one side, and have latch elements on the other side, allowing the hinged unit to be assembled to a tabletop around an umbrella post, and to be removed. Also in one embodiment an injection molded unit is provided within the first housing, the unit having sockets accommodating motor and impeller units for fans. In one embodiment there are four centrifugal fans directed horizontally at ninety degree increments. In one embodiment there is further a source of one or more of air freshener, scent or insect-repellent conditioning the air supplied by the apparatus.

DETAILED DESCRIPTION OF THE INVENTION

Figure 1A:
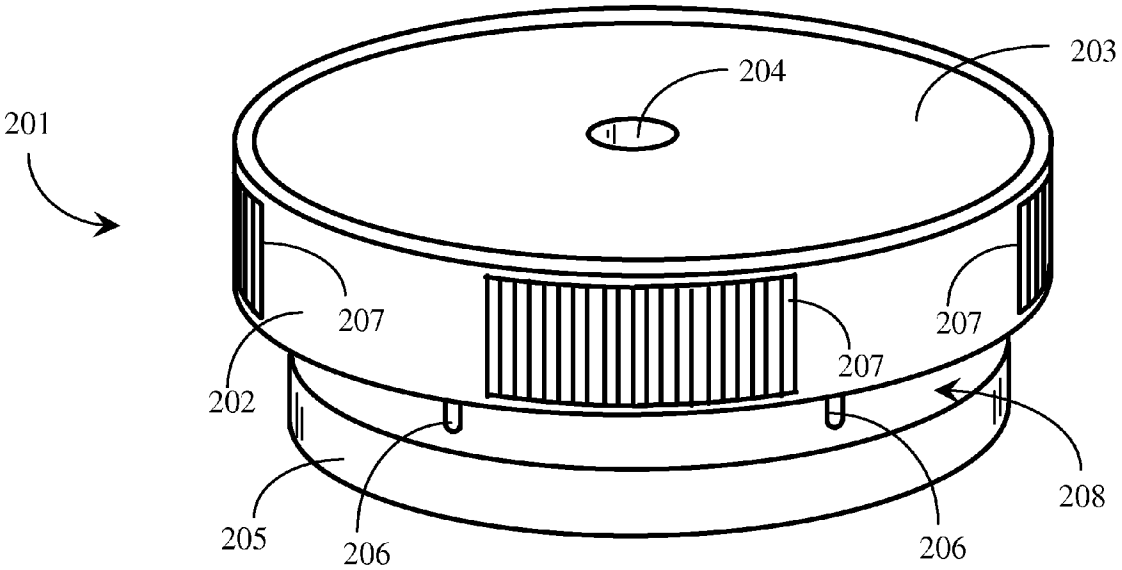
FIG. 1*a* is a perspective view of a tabletop air cooler according to an embodiment of the invention.
Figure 1B:
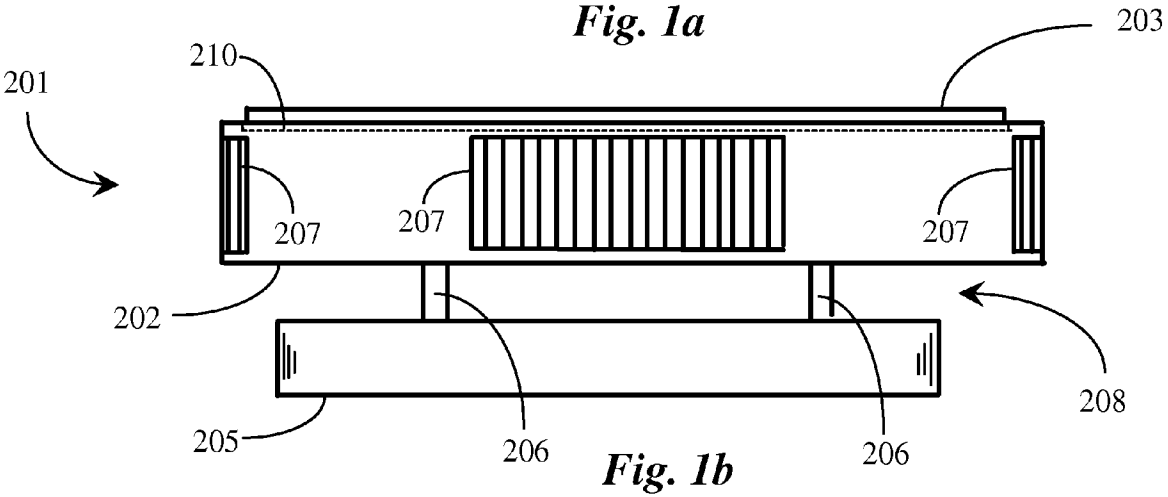
FIG. 1*b* is an elevated frontal view of the tabletop air cooler of FIG. 2*a*.

Referring to FIG. 1*a* and FIG. 1*b*, a tabletop air cooler 201 in an embodiment of the invention comprises a fan unit 202 that generates multiple streams of air flow in multiple directions. A base unit 205 is spaced apart from and supports and supplies power to fan unit 202. A centrally disposed aperture 204 at the center of tabletop air cooler 201 that extends through fan unit 202 and base unit 205 provides an opening to accommodate post 103 (See FIG. 1). A plurality of spacers 206 separate fan unit 202 and base unit 205 in this embodiment, providing an opening 208 allowing outside air to flow under fan unit 202. Spacers 206 may be a metal bolts secured by nuts at fan unit 202 and base unit 205 but may be any means of metal, wood, plastics, or any other materials that may provide the necessary support.

Fan unit 202 has a removable cover 203 in one embodiment that forms a top surface to allow easy installation and servicing of components inside. In an alternative embodiment there may be a bearing assembly 210 and a rotatable platform on the top of the fan unit, providing a surface for placing condiments, for example. A series of outlets 207 may be arranged around the outside of fan unit 202, and each may have an associated blower that draws in outside air from an accompanying air intake opening in the bottom of the fan unit. The blowers urge the outside air from the air intake openings through the associated outlets 207 to create directed air flow. With multiple outlets 207 the tabletop air cooler generates multiple streams of air flow in different directions to meet the needs of users sitting around a table. In this exemplary embodiment there are four outlets 207 generating directed streams of air in different directions. In some embodiments movable vanes are provided at the outlet openings to provide for further directional control of the air flow.

Base unit 205 in one embodiment supports fan unit 202 with spacers 206 creating an annular opening 208 to allow outside air to be drawn in to the fans to be urges outward through outlets 207. The base unit also provides power to fan unit 202. Base unit 205 may comprise one or more rechargeable battery packs as power storage and circuitry for charging the battery packs. In some embodiments the battery pack or packs may be easily removed to be recharged, and quickly replaced with packs that are already charged. Fan unit 202 and base unit 205 may electrically coupled through a wire harness, such as a set of insulated wires attached to fan unit 202 at one end and to base unit 205 at the other end, whereby power may be supplied to fan unit 202 from base unit 205. An on-off switch and a port for a power supply for recharging are also provided, but not shown in this view.

Figure 2A:
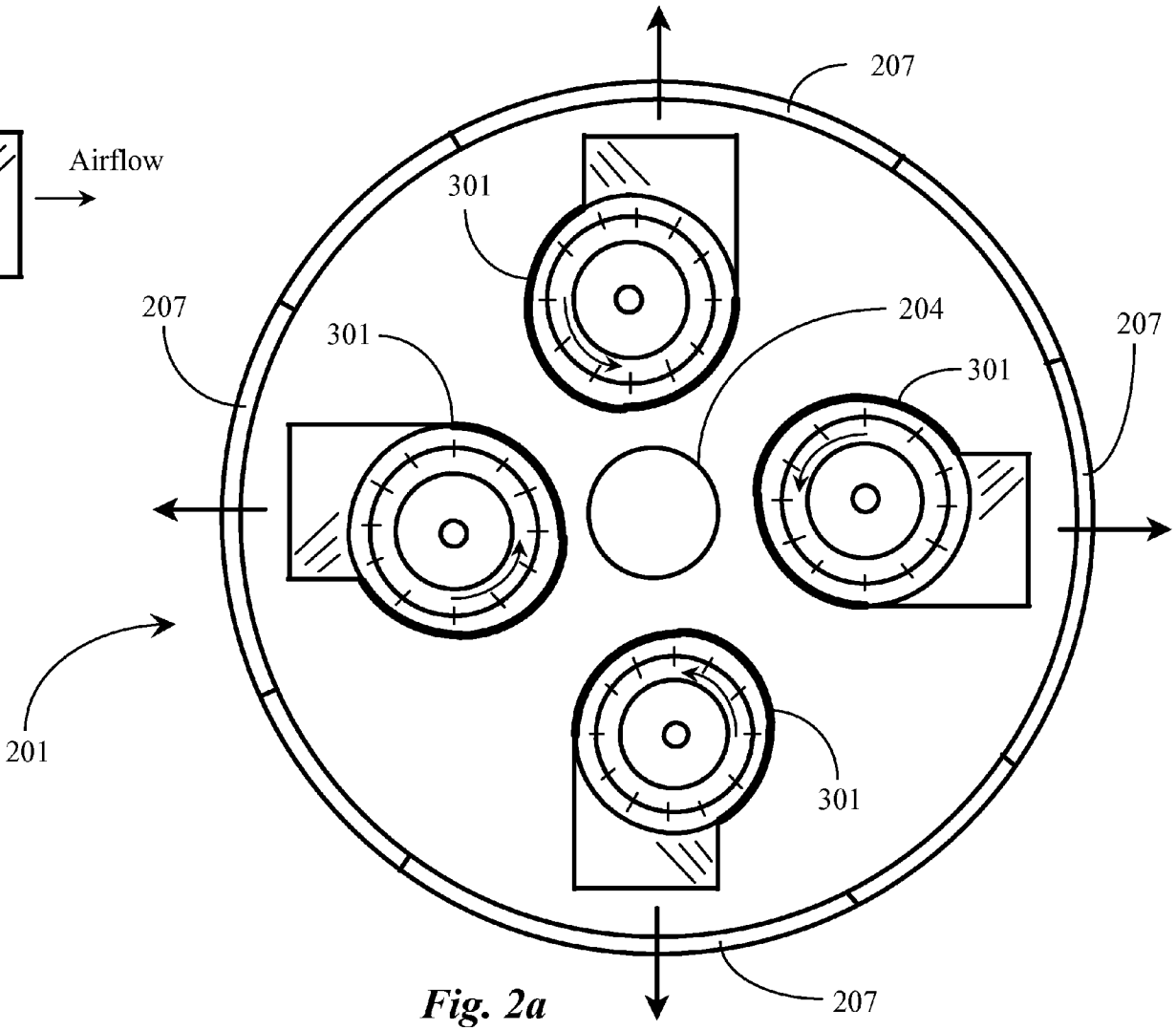
FIG. 2*a* is a plan view of a blower in a tabletop air cooler according to an embodiment of the invention.

FIG. 2*a* is a plan view of tabletop air cooler 201 shown with top removed, with four internally-mounted fan units 301. In this exemplary embodiment there are four fans 301 that generate four streams of air directed through the four associated outlets 207. In other embodiments there may a different number of fans 301 with a different number of outlets 207. There also is no strict association of a number of fans with a number of outlets. A single fan might have a number of outlets.

Figure 2B:
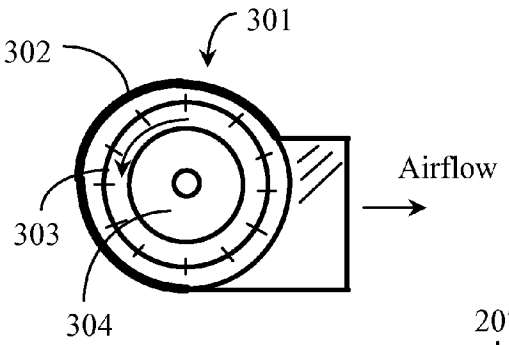
FIG. 2*b* is a top-down plan view of a tabletop air cooler with its cover removed according to an embodiment of the invention.

FIG. 2*b* illustrates an example of fan 301 as a centrifugal fan that comprises a housing 302 with a motor 304 that rotates an impeller 303, accelerating air radially and changing the direction (typically by 90 degrees) of the airflow. A centrifugal fan is sturdy, quiet, reliable, and capable of operating over a wide range of conditions, but other suitable fans such as a cross flow fan and axial-flow fan may also be used in alternative embodiments. In one embodiment tabletop air cooler 201 with a specified number of outlets, fans, and air intake openings may be constructed as a single molded plastic housing assembled with motors 304 and impellers 303.

Figure 3:
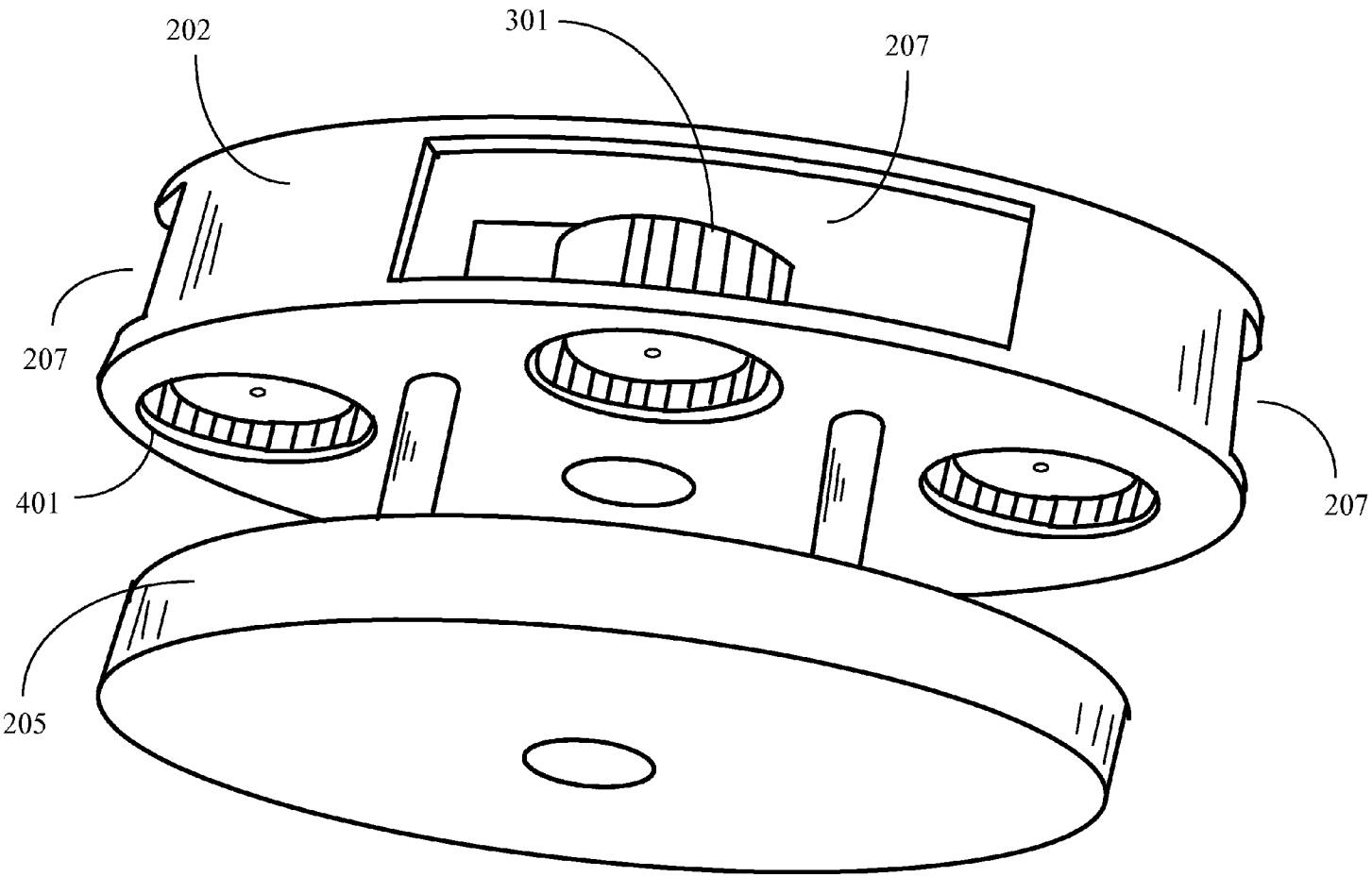
FIG. 3 is a perspective elevation view of the bottom of a tabletop air cooler according to an embodiment of the invention.

FIG. 3 provides a perspective bottom view of tabletop air cooler 201. At the bottom of fan unit 202 is a series of air intake openings 401. Each air intake opening 401 is associated with a blower 301 from which outside air is drawn in from the air space between fan unit 202 and base unit 205. Fans 301 force air from air intake openings 401 through associated outlets 207, creating a directed air flow toward persons sitting around a table. In this example there are four air intake openings 401 associated with four fans 301 and four outlets 207, creating four streams of directional air flow to persons sitting around a table.

Figure 4A:
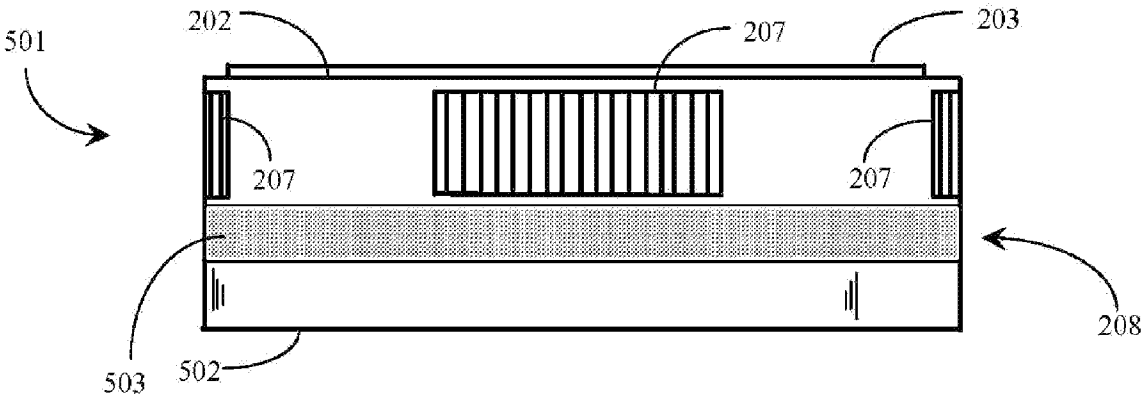
FIG. 4*a* is an elevation view of a tabletop air cooler according to an alternative embodiment of the invention wherein multiple directional streams of filtered air are generated.

FIG. 4*a* illustrates an alternative embodiment of a tabletop air cooler 501 wherein multiple directional streams of filtered air flow are generated. The space between fan unit 202 and extended base unit 502 of the tabletop air cooler is enclosed by a filter element 503 that filters outside air before the air is drawn into air intake opening 401.

Figure 4B:
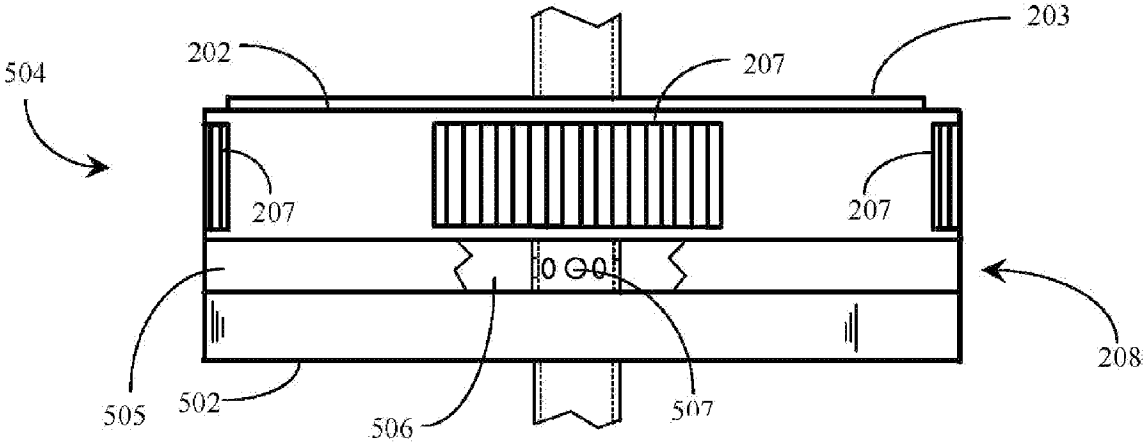
FIG. 4*b* is an elevation view of a tabletop air cooler according to an alternative embodiment of the invention wherein multiple directional streams of conditioned air are generated.

FIG. 4*b* illustrates an alternative embodiment of a tabletop air cooler 504 wherein multiple directional streams of conditioned air flow are generated. The air space between fan unit 202 and enlarged base unit 502 of the tabletop air cooler in this example is enclosed by a cylindrical housing 505 that blocks outside air from entering into the bottom of fan unit 202, creating an air chamber 506 between fan unit 202 and extended base unit 502. A series of openings 507 are provided on post 103 at the area encircled by housing 505, which allows conditioned air to be drawn from within post 103 to air chamber 506, providing conditioned air to flow in and through air intake openings 401. Fans 301 direct the conditioned air to outlets 207, creating directional conditioned air flows. The conditioned air may be hot or cold, creating either a heating or a cooling effect to further enhance a users' experience. The conditioned air may be generated from an external heating source for hot air, perhaps under the umbrella, or an external cooling source for cold air, perhaps under the table. In addition, the conditioned air in any embodiment of the invention may be scented, exposed to an air freshener source, or insect repellent may be added.

In some embodiments of the table-top air cooler there is a centrally disposed aperture at the center to allow passage of an umbrella post in some embodiments. This is not a limiting feature, and many embodiments have no such opening, and may accommodate placement on just about any flat surface. An on/off switch on tabletop air cooler 201 enables or disables its operation, allowing operators to turn on the tabletop air cooler only when needed. A charging port on tabletop air cooler 201 provides an interface to charge rechargeable batteries in base unit 205. In some embodiments replaceable batteries that are not rechargeable may be used. In addition, tabletop air cooler 201 may have an electrical cord that may be connected to an electrical outlet to supply power to fan unit 202 when an electrical outlet is conveniently located nearby, allowing the tabletop air cooler to operate with or without an electrical cord.

Figure 5:
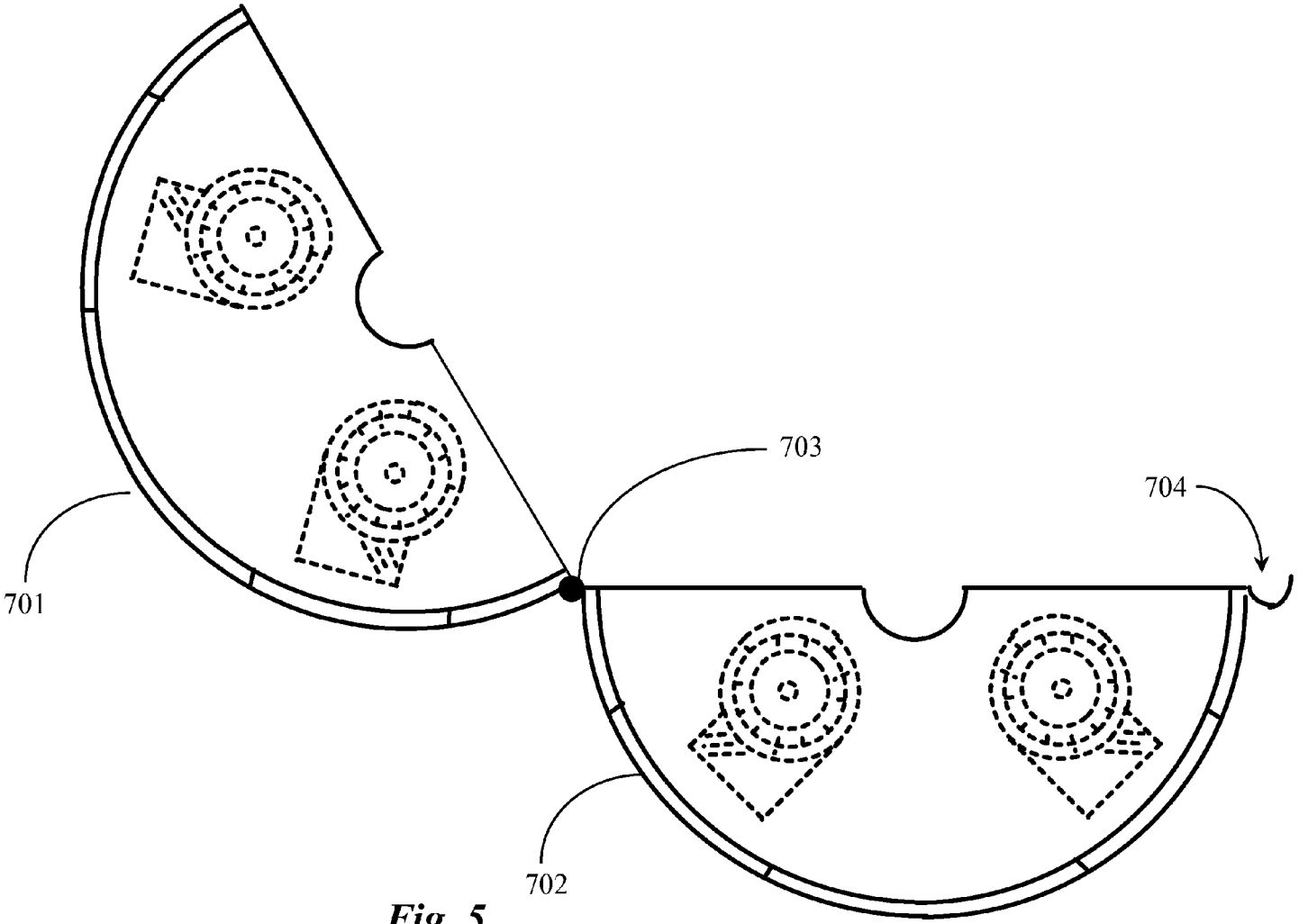
FIG. 5 is a plan view of a tabletop air cooler according to an alternative embodiment of the invention wherein the tabletop air cooler is separable into 2 sections.

FIG. 5 illustrates an alternative embodiment of a tabletop air cooler wherein the cooler may be separated into a first section 701 and second section 702, with the first section 701 selectively separable from second section 702. The first section 701 and second section 702 each may compromise half of the fans in the fan unit and half of the energy storage devices in the base unit. The first section 701 and the second section 702 may be minor images. In one embodiment the fan unit of first section 701 comprises two of the four blowers 301 and the fan unit of the second section 702 has the other two blowers 301. The energy storage devices may also be evenly divided between the base units of the first section 701 and second section 702. However, if only one energy storage device is present, the energy storage device may reside in the base unit of either first section 701 or second section 702, but may be electrically coupled and shared by both fan units in first section 701 and second section 702.

In one embodiment a hinge 703 may join one end of first section 701 and one end of second section 702, with a latch 704 on the other end of second section 702 to lock to first section 701 allowing the two sections to join. However, the two sections do not need to join physically to operate and may be separated. The centrally disposed aperture 204 is positioned between adjoining edges of the first section 701 and section 702 to allow for positioning around the post 103 when the two sections are placed together. The ability to separate the tabletop air cooler into two sections allows the tabletop air cooler to be easily installed or uninstalled on top of the table without removing the post from the supporting weight.

In yet another embodiment a bearing support may be placed in fan unit 202 of the tabletop air cooler to support cover 203. The bearing support provides a frictionless area of rotation between the base of fan unit 202 and the bottom of cover 203, forming a rotatable surface on fan unit 202. The rotatable surface of fan unit 202 becomes a lazy Susan, or a tray that rotates in a circular direction in relation to the table to aid the passage of foods. The tabletop air cooler equipped with the rotatable surface may be placed in the center of the table to generate multiple streams of air flow and to aid the passage of food and other items. It resolves the shortcoming of a conventional rotatable tray that cannot be placed on the center of a patio table having an umbrella.

In another embodiment, each outlet 207 on fan unit 202 of the tabletop air cooler may have an associated control to set the speed of fan 301 to adjust the rate of air flow. The individual outlet control allows each outlet to be adjusted according to different user's needs. Such controls may be a variable-speed dial or other digital control means such as wireless, Bluetooth or other control system as is known in the art.

The invention has been described above with reference to tables with a central umbrella mounting, with features of the cooler to accommodate such an umbrella mounting. The invention is not limited to such tables, but embodiments may be provided in different shapes than round, and without a central opening. Some embodiments of the air movement apparatus may be square or rectangular in shape, or of other shapes, and may be used with tables of essentially any shape to provide air movement over the tabletop for convenience and comfort of persons seated at the table. In some embodiments a fan unit may be mounted below a table, and air may be directed trough openings in the table in a manner to provide air flow outward toward persons seated around the table. There are many possibilities.

It will thus be apparent that there has been provided in accordance with the present invention a tabletop air cooler which achieves the aims and advantages specified herein. It will be apparent to the skilled person that there may be many alterations in the embodiments described without departing from the scope of the invention. For example, although the invention has described the base unit comprising one or more rechargeable battery packs to power the fan unit, it will be appreciated that other power source such as solar panels may be used to provide power to the fan unit of the tabletop air cooler. For example, although the invention has illustrated the tabletop air cooler with a circular, centrally disposed aperture to accommodate the umbrella post through the patio table, it will be appreciated that other shapes of the centrally disposed aperture may be used to achieve the intended purpose. All such variations and modifications are intended to come within the scope of the present invention.

What is claimed is:

1. An apparatus comprising:

a circular housing having a top, a bottom and a sidewall, the bottom adapted to support the circular housing on a tabletop, and a vertically-oriented central opening in the circular housing for an umbrella post to pass through;

multiple horizontally-directed outlet openings through the sidewall, evenly spaced around the sidewall, and one or more inlet openings through the bottom of the circular housing;

one or more fans mounted within the circular housing, positioned to draw air through the one or more inlet openings, and to urge the air horizontally outward through the multiple horizontally-directed outlet openings;

a bearing assembly supporting a rotating platform on the top of the circular housing, such that the rotating platform, with the apparatus placed centrally on the tabletop, provides a rotatable surface for supporting and distributing foods and condiments to persons seated around the tabletop, and a power source located in a housing, coupled to the one or more fans and connected through an on-off switch to turn the one or more fans on and off.

2. The apparatus of claim 1 wherein the power source is a battery pack implemented in the housing.

3. The apparatus of claim 2 wherein the batteries in the battery pack are rechargeable, and the apparatus includes a port for connecting to a power supply for recharging the batteries.

4. The apparatus of claim 2 wherein the circular housing is a first housing enclosing the one or more fans but not the battery pack, wherein the housing the battery pack is implemented in is a separate second housing spaced apart below the first housing by a plurality of spacers.

5. The apparatus of claim 4 wherein the first housing is spaced apart above the second housing enclosing the battery pack, and the one or more inlet openings are formed through the bottom of the first housing and open into a space located between the first housing and the second housing, such that air is drawn into the space between the first housing and the second housing by the one or more fans.

6. The apparatus of claim 1 comprising four centrifugal fans within the circular housing, each fan being directed horizontally at ninety degree increments.

7. The apparatus of claim 1 further comprising a source of one or more of air freshener, scent or insect-repellent, conditioning the air supplied by the apparatus.

8. The apparatus of claim 1 wherein each one of the one or more fans is connected to a control enabled to set the fan speed individually for each fan, providing ability to adjust flow for individual user's needs.

* * * * *